United States Patent [19]

Santén et al.

[11] Patent Number: 4,652,725

[45] Date of Patent: Mar. 24, 1987

[54] METHOD AND APPARATUS FOR HEATING A FIRST GAS FLOW WITH A SECOND GAS FLOW

[75] Inventors: Sven Santén; Ivar Ledin, both of Hammarvägen, Sweden

[73] Assignee: SKF Steel Engineering AB, Hofors, Sweden

[21] Appl. No.: 580,733

[22] Filed: Feb. 16, 1984

[30] Foreign Application Priority Data

Aug. 4, 1983 [SE] Sweden ..... 8304273

[51] Int. Cl.[4] ..... B23K 9/00

[52] U.S. Cl. ..... 219/121 PY; 219/121 P; 219/121 PQ; 219/121 PP; 266/265; 266/270; 432/219; 432/223

[58] Field of Search ..... 219/121 P, 121 PY, 121 PP, 219/121 PN, 121 PQ, 280, 359, 367, 368; 266/265, 267, 270; 432/64, 219, 223

[56] References Cited

U.S. PATENT DOCUMENTS 2,941,063 6/1960 Ducati et al. ..... 219/121 PN
3,891,562 6/1975 Mogensen et al. .
3,970,290 7/1976 Santen et al. .
3,988,421 10/1976 Rinaldi .
4,072,502 2/1978 Santen et al. .
4,145,403 3/1979 Fey et al. ..... 219/121 PQ
4,266,113 5/1981 Denton et al. ..... 219/121 P
4,370,538 1/1983 Browning ..... 219/121 PQ

FOREIGN PATENT DOCUMENTS 2107841A 5/1983 United Kingdom .

*Primary Examiner*—M. H. Paschall
*Attorney, Agent, or Firm*—Armstrong, Nikaido, Marmelstein & Kubovcik

[57] ABSTRACT

The invention relates to a method and an apparatus for heating up a first gas-flow with a second gas-flow. The first gas-flow is caused to flow along a wall in a cylindrical chamber as a rotating gas-flow and the second gas-flow is caused to flow centrally in the chamber, surrounded by the first gas-flow, so that the wall is protected.

The apparatus comprises a chamber having an inlet section designed as a whirlpool chamber and an elongate cylindrical mixing part non-radial inlets for the first gas-flow, having their orifices in the wall of the whirlpool chamber and having an inlet for the second gas-flow, arranged substantially centrally in the end of the whirlpool chamber facing away from the mixing part, as well as an outlet section arranged in the mixing chamber part opposite the whirlpool chamber.

6 Claims, 2 Drawing Figures

METHOD AND APPARATUS FOR HEATING A FIRST GAS FLOW WITH A SECOND GAS FLOW

BACKGROUND OF THE INVENTION

The present invention relates to a method of heating up a first gas-flow with a second gas-flow, particularly for heating gas for use in high-temperature processes such as the production of metal, garbage, incineration, etc., and to an apparatus for performing the method.

It is known per se to heat blast gas for use in blast furnaces by means of a gas heated in a plasma generator. See Swedish Pat. No. 73 04 333-3. The problem with this previously known process is the high temperature in combination with high gas velocity to which the lining is subjected. This results in excessive wear particularly where the extremely hot gas-flow is expelled.

Another problem is the uncontrolled and poor mixing of the gases, resulting in hot jets in the gas mass. This is particularly disadvantageous when solid and/or liquid fuel is to be mixed with the gas before it enters the blast furnace.

The object of the present invention is thus to eliminate the above drawbacks and effect a method of heating one gas with another gas in such a way that the defining walls are protected and that the gases are gradually and thoroughly mixed.

BRIEF SUMMARY OF THE INVENTION

This is achieved with the method according to the invention in that the first gas-flow is caused to flow along a wall in a cylindrical chamber as a rotating gas-flow and that the second gas-flow is caused to flow substantially centrally in the chamber, surrounded by the first, rotating gas-flow, so that the wall is protected. The cooler gas thus forms a protective layer around the centrally flowing gas-flow, often extremely hot, and the service life of the lining is greatly increased.

The means for performing the method according to the invention comprises a chamber having an inlet section designed as a whirlpool chamber and an elongate cylindrical mixing part, non-radial inlets for the first gas-flow, having their orifices in the wall of the whirlpool chamber and having an inlet for the second gas-flow, arranged substantially centrally in the end of the whirlpool chamber facing away from the mixing part, as well as an outlet section arranged in the mixing chamber part opposite the whirlpool chamber.

BRIEF DESCRIPTION OF THE DRAWINGS

Further advantages and features of the invention will be revealed in the following description with reference to the accompanying drawings in which.

DESCRIPTION OF THE PREFERRED EMBODIMENT

Figure 1:
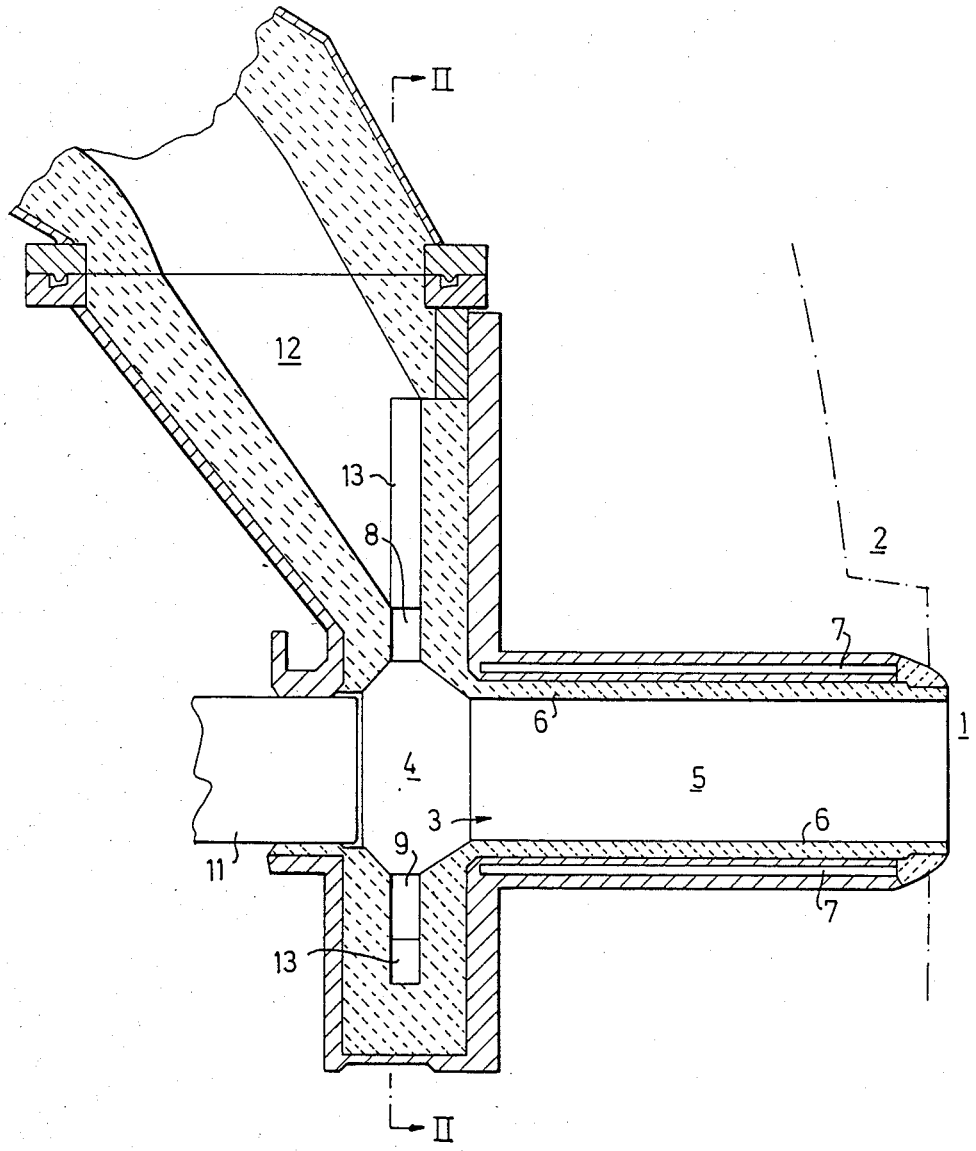
FIG. 1 shows a schematic cross-sectional view through a means for performing the method according to the invention as applied to supplying blast gas to blast furnaces.

FIG. 1 shows a means for connection to a conventional tuyère, indicated at 1, arranged in the wall of a blast furnace indicated at 2. As mentioned in the introduction, the invention is of course suitable for other applications such as garbage incineration and waste destruction in shaft furnaces.

Figure 2:
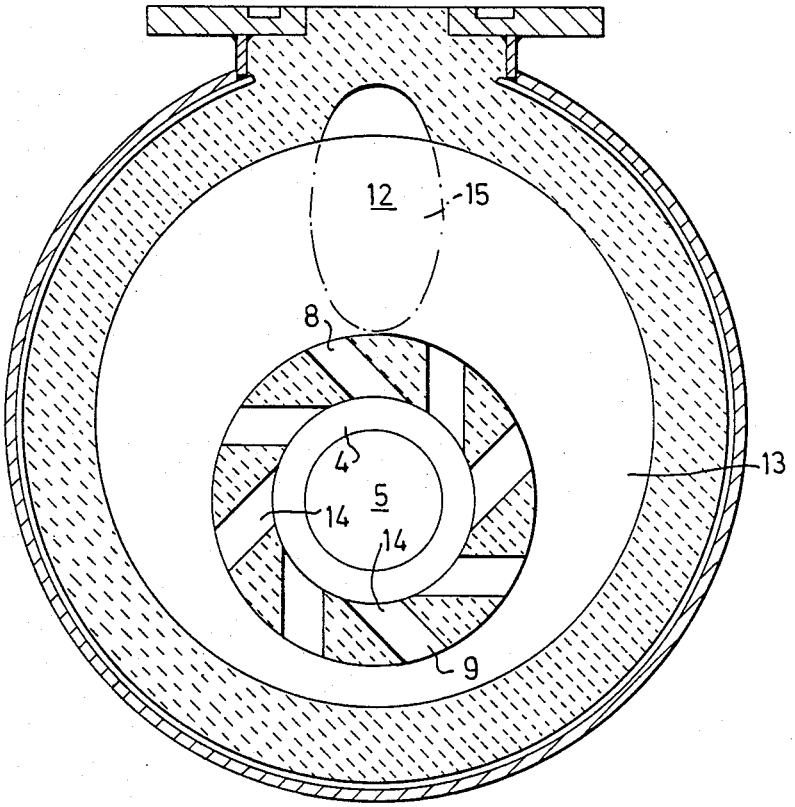
FIG. 2 shows a cross-sectional view taken along the line II—II in FIG. 1.

The main parts of the means are a chamber 3 comprising whirlpool chamber 4 and mixing chamber 5 having cylindrical cross section. The entire chamber is provided with a refractory lining 6 and is partially water-cooled 7. Channels 8, 9 with non-radial orifices open into the whirlpool chamber, see FIG. 2. In the embodiment shown here a heating means 11 producing a hot gas-flow opens into the end of the chamber. Lances may also be arranged in the whirlpool chamber 4 for the supply of carbonaceous fuel or other substances. However, this is not shown in detail on the drawings.

Various types of heating means are feasible. However, plasma generators have great advantages, primarily that a large quantity of energy can be transmitted with a relatively small quantity of gas.

The gas-flow to be heated is supplied through a channel 12. The gas then flows in an annular gap 13 from which channels 8, 9 having non-radial inlets 14 extend, see also FIG. 2. The gas flows into the gap 13 through openings 15.

The essential feature of the invention is that the hot gas is prevented from coming into contact with the wall lining while at the same time the gases are mixed as uniformly and as free from disturbance as possible. Naturally the design can be varied in many ways within the scope of the invention. For instance channels 8, 9 may advantageously be curved in the form of blades. The number of channels may also be varied, as well as the inflow angle.

EXAMPLE

When the invention was applied in a shaft furnace plant for the manufacture of pig-iron 5000 $m^3N$ air/-hour was supplied to the chamber at a temperature of 1300° C., together with 375 $m^3N$ air/hour from the plasma generator at a temperature of almost 3000° C. Upon entering the furnace tuyère the mixture had an essentially uniform temperature of ca. 1800° C. and no damage could be observed on the lining.

We claim:

1. Apparatus for heating a first larger volume gas-flow with a second smaller volume gas-flow, said apparatus comprising a chamber having (1) an inlet section defining a whirlpool chamber and (2) an elongate cylindrical mixing section; non-radial inlets for the first gas-flow having their orifices in the wall of the whirlpool chamber; an annular space surrounding said non-radial inlets and providing said non-radial inlets with said first gas-flow; an inlet for the second gas-flow arranged substantially centrally in the end of the whirlpool chamber facing away from the mixing section, and an outlet arranged in the mixing section opposite the whirlpool chamber, wherein said whirlpool chamber directs the first gas-flow to rotate along the wall of the chamber and the second gas-flow flows centrally in the chamber.

2. Apparatus according to claim 1, in which the chamber is water-cooled and refractory lined.

3. Apparatus according to claim 1, in which the chamber has an enlarged part located at the upstream end and functioning as whirlpool chamber, in which the orifices of the non-radial inlets are located.

4. Apparatus according to claim 3, in which the downstream end of the chamber is designed for connection to a conventional blast furnace tuyère.

5. A method for heating a first larger volume gas-flow with a second smaller volume gas-flow, comprising heating said second smaller gas-flow to a high temperature and introducing said heated second smaller gas-flow into the central portion of a whirlpool chamber; simultaneously with the introduction of said heated second smaller gas-flow into the whirlpool chamber, introducing said first larger gas-flow tangentially into the whirlpool chamber to cause said first larger gas-flow to flow along the circumference of said chamber and to surround said heated second smaller gas-flow; and passing said second smaller heated gas-flow and said first larger gas-flow through a cylindrical mixing chamber wherein said gas-flows are uniformly mixed and said first larger gas-flow is heated.

6. Apparatus for heating blast gas for use in blast furnaces comprising a means for heating a first larger volume gas-flow with a second smaller volume gas-flow, said means comprising a chamber having (1) an inlet section defining a whirlpool chamber and (2) an elongate cylindrical mixing section; non-radial inlets for the first gas-flow having their orifices in the wall of the whirlpool chamber; an annular space surrounding said non-radial inlets and providing said non-radial inlets with said first gas-flow; an inlet for the second gas-flow arranged substantially centrally in the end of the whirlpool chamber facing away from the mixing section and an outlet arranged in the mixing section opposite the whirlpool chamber, wherein said whirlpool chamber directs the first gas-flow to rotate along the wall of the chamber and the second gas-flow flows centrally in the chamber;

a plasma generator for heating said second smaller gas-flow and connected to said inlet for the second gas-flow; and a tuyere connected to said outlet arranged in the mixing section for receiving a mixture of said first gas-flow and said second gas-flow.

* * * * *